US006612244B1

(12) United States Patent
Grosch et al.

(10) Patent No.: US 6,612,244 B1
(45) Date of Patent: Sep. 2, 2003

(54) METHOD AND DEVICE FOR DESTROYING DRIFTING SEA MINES

(75) Inventors: Hermann Grosch, Nienhagen; Werner Hasse, Hamburg; Uwe Eisenkolb, Lüneburg, all of (DE)

(73) Assignee: Rheinmetall Landsysteme GmbH, Kiel (DE)

( * ) Notice: Subject to any disclaimer, the term of this patent is extended or adjusted under 35 U.S.C. 154(b) by 0 days.

(21) Appl. No.: 09/482,628

(22) Filed: Jan. 14, 2000

(30) Foreign Application Priority Data

Jan. 14, 1999 (DE) ..... 199 01 083

(51) Int. Cl.[7] ..... B63G 9/00; F42B 22/42; F42B 7/02

(52) U.S. Cl. ..... 102/402; 102/403

(58) Field of Search ..... 102/402, 403

(56) References Cited

U.S. PATENT DOCUMENTS 5,689,086 A 11/1997 Stottlemyer

FOREIGN PATENT DOCUMENTS

| | | | |
|---|---|---|---|
| DE | 19543757 A1 | 5/1997 | |
| DE | 19633008 A1 | 2/1998 | |
| DE | 19716512 A1 | 10/1998 | |
| DE | 19825913 C1 | 2/2000 | |
| EP | 0872705 | * 10/1998 | ..... F42B/12/66 |
| FR | 864536 | * 4/1941 | ..... 102/402 |

OTHER PUBLICATIONS

"Minenbekämpfung [Combating Mines]" wt, No. 10/3/80, pp. 66 and 67.

Diehl Munitionssysteme GmbH & Co. KG, May 11, 2001.

* cited by examiner

*Primary Examiner*—Michael Garone
*Assistant Examiner*—M Thomson
(74) *Attorney, Agent, or Firm*—Venable, LLP; Norman N. Kunitz

(57) ABSTRACT

A method and a device for destroying drifting sea mines (5). According to the invention, a capture-and-destroy device (11) is brought into the vicinity of the drifting sea mine (5) with the aid of a buoyant body (12, 22) having a coupled-on drive system (13) or a drive device (24), and the mine is captured in that the sea mine (5) is surrounded by deployment of a capture net (16) normally located in a capture unit (11.1) of the capture-and-destroy device (11). A motorized element (17) disposed in the capture unit (11.1) draws the capture net (16) together automatically until the captured sea mine (5) rests directly against a destroyer unit (11.2) with a destructive charge (15). The destructive charge (15) is then automatically detonated to destroy the mine.

14 Claims, 7 Drawing Sheets

METHOD AND DEVICE FOR DESTROYING DRIFTING SEA MINES

CROSS REFERENCE TO RELATED APPLICATION

This application claims the priority of German Application No. 199 01 083.8 filed Jan. 14, 1999, the subject matter which is incorporated by reference.

BACKGROUND OF THE INVENTION

The invention relates to a method and a device for destroying drifting sea mines.

Drifting sea mines are moored mines that have been set adrift by the tearing or uncontrolled separation of their wire cable or chain from the anchor or mine base. Prerequisites for destroying these uncontrollably drifting sea mines include detecting and identifying them, and determining their position. This is effected, for example, with the use of sonar systems on specially-equipped ships, optronic viewing devices and visual observations. The drifting sea mines are destroyed through bombardment, by underwater drones or by the application of a destructive charge. A disadvantage of this type of destruction is the high cost of bombarding these sea mines, or the possibility that the mines will only be damaged, and not destroyed, meaning that dangerous ballast remains in the water. Moreover, the application of a destructive charge, for example by a diving apparatus, is both time-consuming and extremely dangerous.

U.S. Pat. No. 5,689,086 describes a cleanup system for cleaning up or clearing away simulated moored mines. A resilient latching shackle dropped from a ship is wound around a wire or a chain that connects the moored mines to an anchor or mine base. Two separate cables, to which the latching shackle is mounted, and two LFDs (Lateral Force Devices) are positioned around the moored mine, and prevent it from slipping out. Afterward, the moored mine is raised, with the anchor base, and taken on board. This system cannot be used to clear away drifting sea mines.

The use of underwater drones to clear away moored mines is described in an article entitled "Minenbekämpfung [Combating Mines]" from the periodical "wt," No. 10/3/80, pp. 66 and 67. For locating the mine, a reference buoy is dropped into the water and the mine-searching sonar on the ship scans a strip approximately 350 m wide and 40 m in front of the device. After the mines have been located, or an underwater object resembling a mine, such as a land mine, has been located, an underwater drone to which, among other things, a camera is secured, is guided to the mine, and the camera is used to identify the mine. Guided solely by the sonar screen, the underwater drone subsequently places a charge, that will destroy the mine, next to the identified object. The underwater drone is then guided back to the ship and hauled onto the deck so the charge can be detonated. This underwater drone, however, can only be used to destroy sand-filled or grounded moored mines, not to clear away drifting sea mines.

Therefore, the need exists for a method and a device with which drifting sea mines can be successfully located and safely destroyed.

SUMMARY OF THE INVENTION

The above object is achieved according to a first aspect of the invention a method of destroying sea mines drifting in a body of water comprising the following steps of placing a buoyant body with a capture-and-destroy unit (11) into the water; using the buoyant body to bring the capture-and-destroy unit into the vicinity of the drifting sea mine; deploying a capture net having a beginning and an end from a capture unit of the capture-and-destroy unit to surround the drifting sea mine, with the capture net being oriented perpendicular to the sea mine; hauling the capture net into the capture unit by winding the end and the beginning of the net into the capture unit until the captured sea mine rests against a destroyer unit of the capture and destroy unit; and, automatically detonating a destructive charge of the destroyer unit to destroy the mine.

The above object is achieved according to a further aspect of the invention by a device for destroying drifting sea mines, comprising: a capture-and-destroy unit mounted to a buoyant body, with the capture and destroy unit including a capture unit and a destroyer unit, which are connected to the buoyant body, with the capture unit including a capture net which is deployed so that it surrounds a drifting sea mine; a buoyancy cord disposed at an upper edge of the capture net, and a plumb cord disposed at a lower edge of the capture net to orient the capture net perpendicular to the sea mine; the capture unit includes means, connected to the capture net, for drawing a beginning and an end of the capture net toward the capture unit until the sea mine rests directly against the destroyer unit; and a destructive charge integrated into the destroyer unit and connected to a detonation-and-safety device.

The concept underlying the invention is to employ a buoyant body having a coupled-on drive system to bring a capture-and-destroy device into the vicinity of the drifting sea mine and capture the mine; in the process, the sea mine is surrounded, and a capturing net, which is located in the capture device of the capture-and-destroy device, is deployed. A motorized device located in the capture device automatically draws the capture net tight until the captured sea mine lies directly against the destroyer device. Then, a destructive or effective charge is detonated. An advantage of this process is that the capture-and-destroy system autonomously reaches the mine position, or maintains the position after reaching it, and the destroyer unit is coupled directly for the reliable destruction of the mine. The destructive charge is positioned to penetrate directly into the effective portion of the drifting sea mine. With the use of a capture net having a width of about 1 m and a length of about 100 m, sea mines of widely-varying sizes can be captured—in other words, the capture-and-destroy system operates independently of the shape and size of the sea mines, so small locating errors can be corrected, because the sea mine can be surrounded over a large area.

Additional features; and advantageous embodiments and modification are disclosed.

After the net has been deployed, the buoyant body provided with the drive unit can be de-coupled, and returns autonomously to the carrier ship for the purpose of re-use, which reduces costs.

In a simple embodiment, the capture-and-destroy system is manned without any threat to personal safety.

In a further embodiment, the capture-and-destroy system is embodied so as to operate completely autonomously. In this instance, the drive system includes drive motors, a navigation system with a navigation computer and a data-storage system. The navigation system comprises a GPS receiver (with antenna), a course-setting device and a course-measuring system. Prior to the start of the mission, mission data and position data relating to the sea mine are read into the data memory, for example through a manual programming device. It is also possible to correct the position data through radio or underwater-sound transmission. The use of a buoyant body permits control through visual contact, which effects an exact capture of the sea mine, which is also visible at the water surface. This can eliminate costly cameras.

The device of the invention is distinguished by a simple design and a high functioning reliability.

The invention is described below in detail by way of exemplary embodiments, in conjunction with the drawings.

BRIEF DESCRIPTION OF THE DRAWINGS

FIG. 5 is a representation of the deployed capture net, with the device from FIG. 1, and the sea mine to be captured.

DETAILED DESCRIPTION OF THE PREFERRED EMBODIMENT

Figure 1:
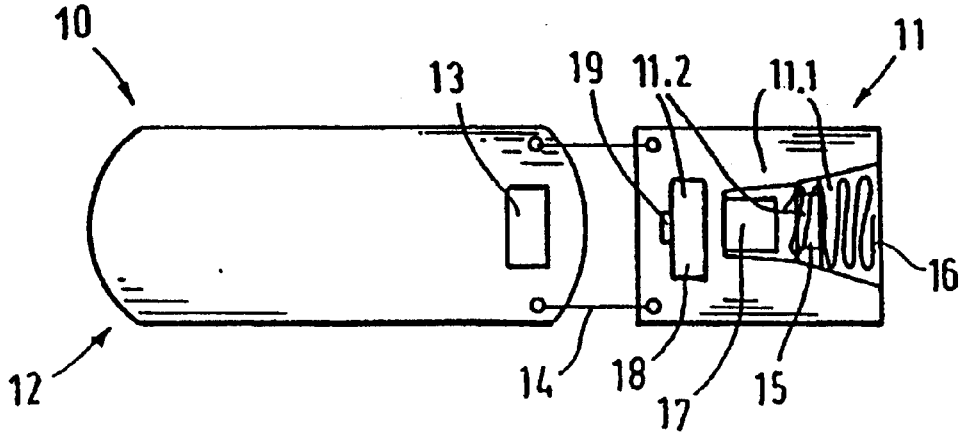
FIG. 1 is a schematic representation of a device according to the invention with an integrated capture net.
Figures 5A, 5B:
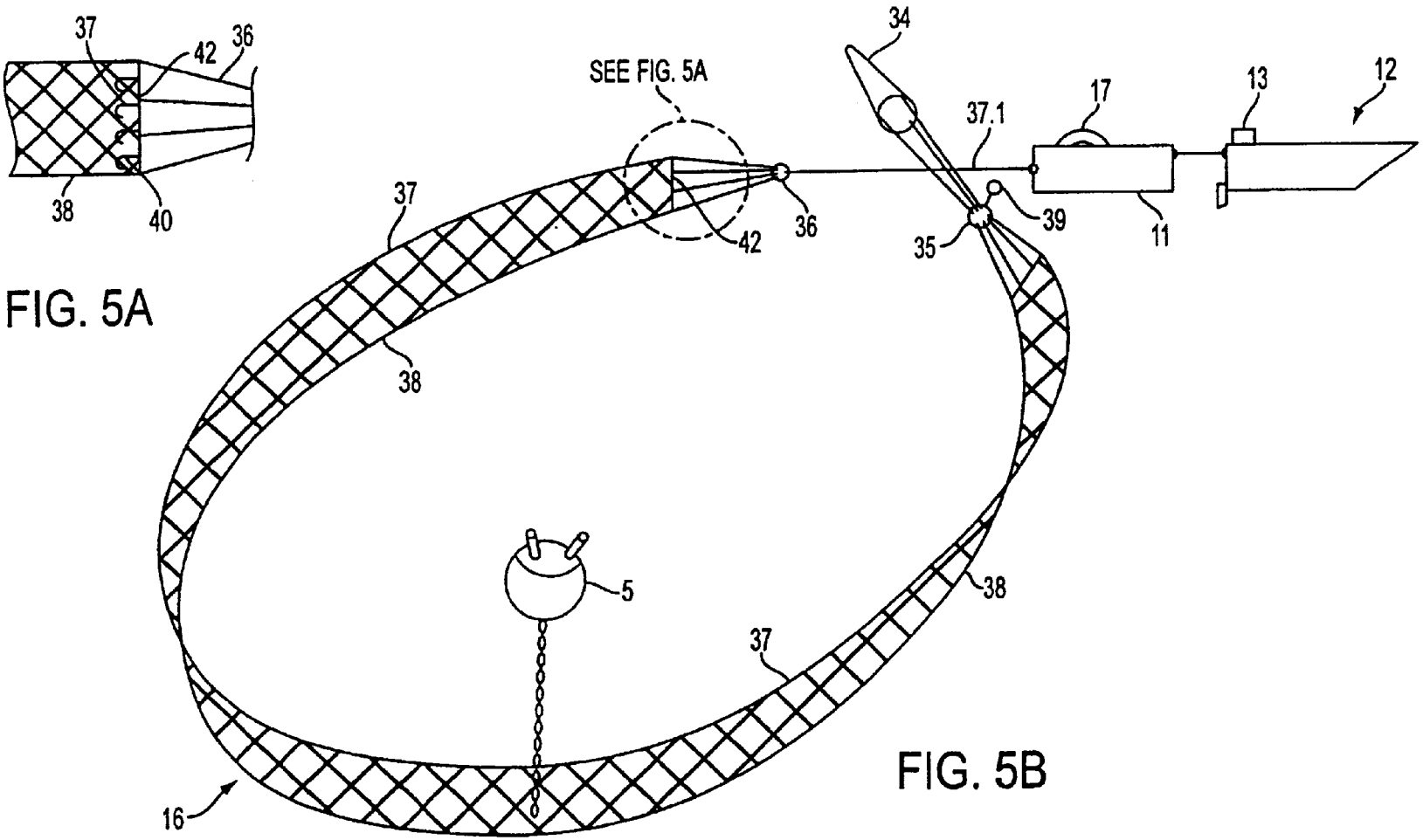
FIGS. 5*a* and 5*b* are a detail view of the capture net end.

FIG. 1 shows a first embodiment of a capture-and-destroy system (CDS) 10 according to the invention. As shown the capture and destroy system comprises a capture-and-destroy unit (CDU) 11 and an additional buoyant body 12, with the capture-and-destroy unit (CDU) 11 being likewise buoyant. The buoyant body 12 has a manual control system, and, for example, a motor-driven drive device 13. The capture-and-destroy unit (CDU) 11 is detachably connected to the buoyant body 12, for example a boat, by way of cables 14. The capture-and-destroy unit 11 comprises a capture unit 11.1 and a destroyer unit 11.2 having a destructive charge 15. The capture unit 11.1 has an integrated capture net 16, to which a drag anchor 34 (see FIG. 5), for example, a wind sack, is secured, and further devices 40 (see FIG. 5*a*), which catch the capture net 16 when the capture unit 11.1 is operating (as will be described below). The capture net 16 is rolled onto a motorized device 17, such as a winch with a motor, or a net roller with a winding motor. The winch 17 is a mechanical component of the capture unit 11.1, to which the capture net 16 remains connected during operation. The destructive charge 15 is preferably positioned in the unit 11 in the vicinity of the winch 17. Furthermore, the destroyer unit 11.2 has a detonation-and-safety device 18, which is electrically connected to a current-supply unit 19 for current supply inside the capture-and-destroy unit 11. A command receiver 20, a control electronics 21 and the winch 17 are also connected to the current-supply unit 19.

Figure 2:
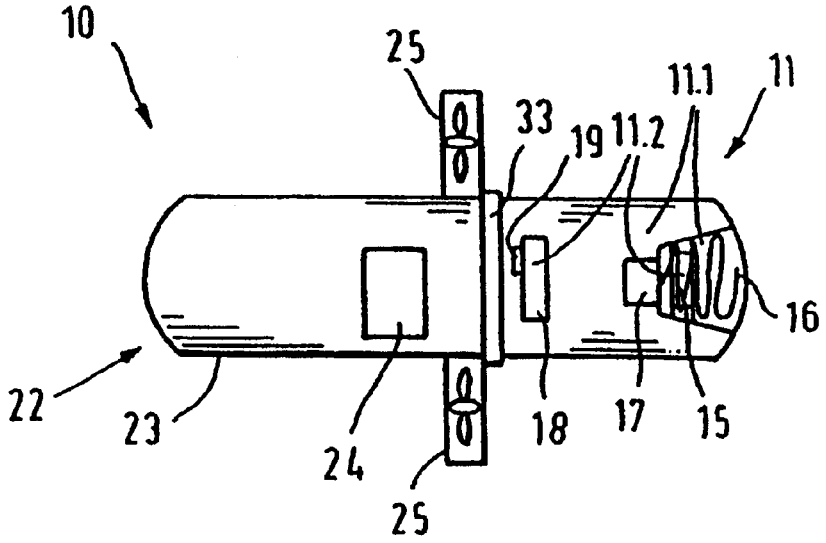
FIG. 2 shows a further embodiment of the device according to the invention.

FIG. 2 shows a further embodiment of the capture-and-destroy system (CDS) 10. This embodiment operates completely autonomously. The capture-and-destroy system 10 also includes the capture-and-destroy unit (CDU) 11 of the invention, and a buoyant body 22, which is formed by a water-tight housing 23, and protects electronic parts of a drive device 24 from water. Drive motors 25 associated with the drive device 24 are mounted, preferably hinged, to the right and left outside of the housing 23. The drive motors 25 are preferably electric motors. The drive can also be effected by way of a controllable hydrojet (not shown).

Figure 3:
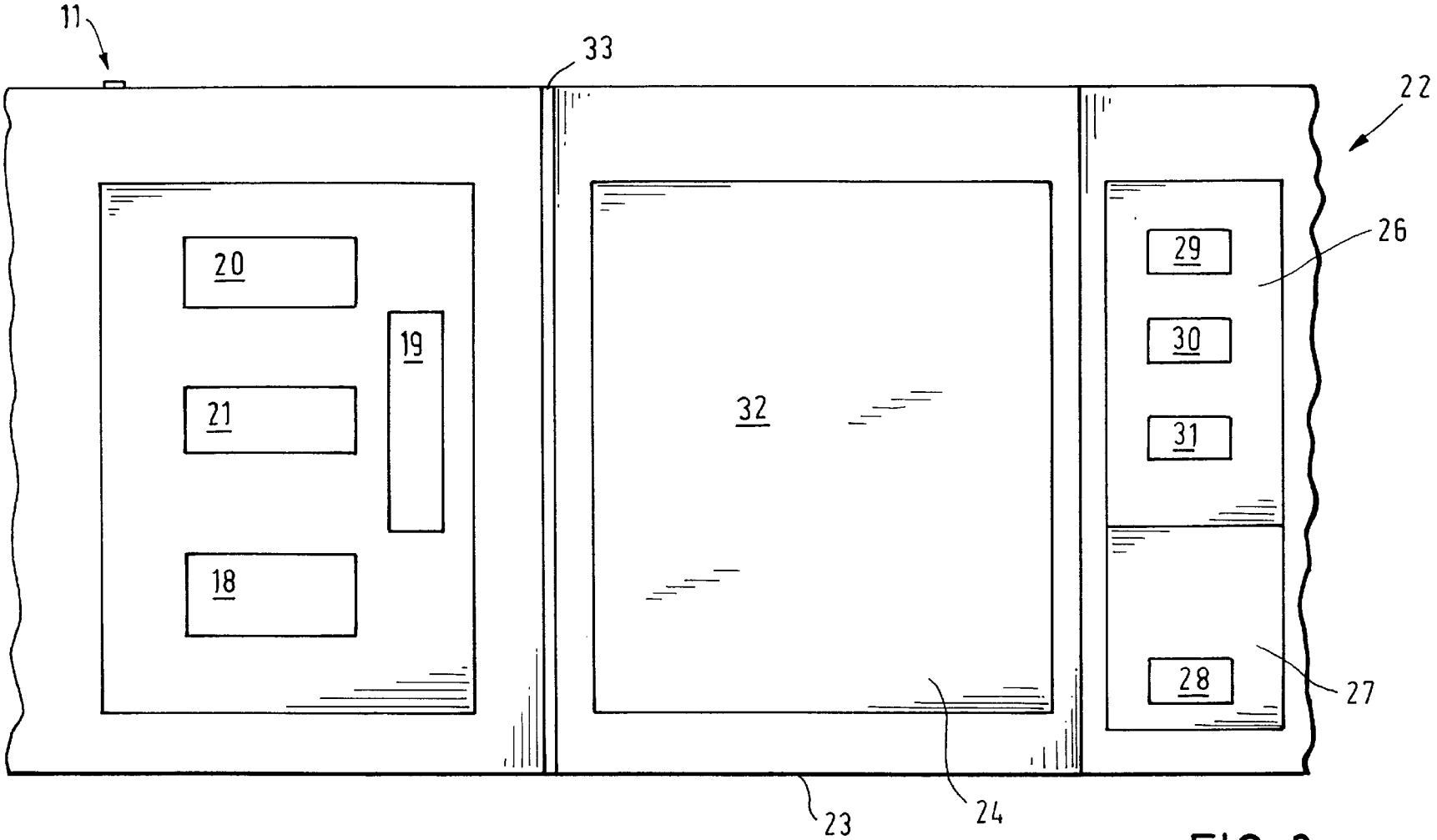
FIG. 3 is a block diagram of the electrical assemblies of the device according to the invention.

Located in the housing 23, and as shown in FIG. 3, is a navigation system 26 with a navigation computer 27, which includes a data memory 28. Preferred elements of the navigation system 26 include a GPS receiver 29, a course-setting device 30, for example a directional gyro, and a log 31 (course-measuring system) for determining the current location and speed of the capture-and-destroy system 10. For supplying the drive device 24 with energy, a drive-and-energy supply device 32 is disposed in the housing 23 and connected to the electronic assemblies and the drive motors 25.

The capture-and-destroy unit 11 is detachably connected to the housing 23 by a coupling device 33. The coupling device 33 effects the mechanical and electronic de-coupling of the capture-and-destroy unit 11 from the housing 23 during operation. On the side opposite the coupling device 33, the capture-and-destroy unit 11 has an exit opening for the capture net 16 integrated into the capture unit 11.1, the drag anchor 34 secured thereto, and further elements 41, which draw together the beginning 35 and the end 36 of the capture net 16 during operation of the autonomous capture unit 11.1 (as will be described below).

Figure 4:
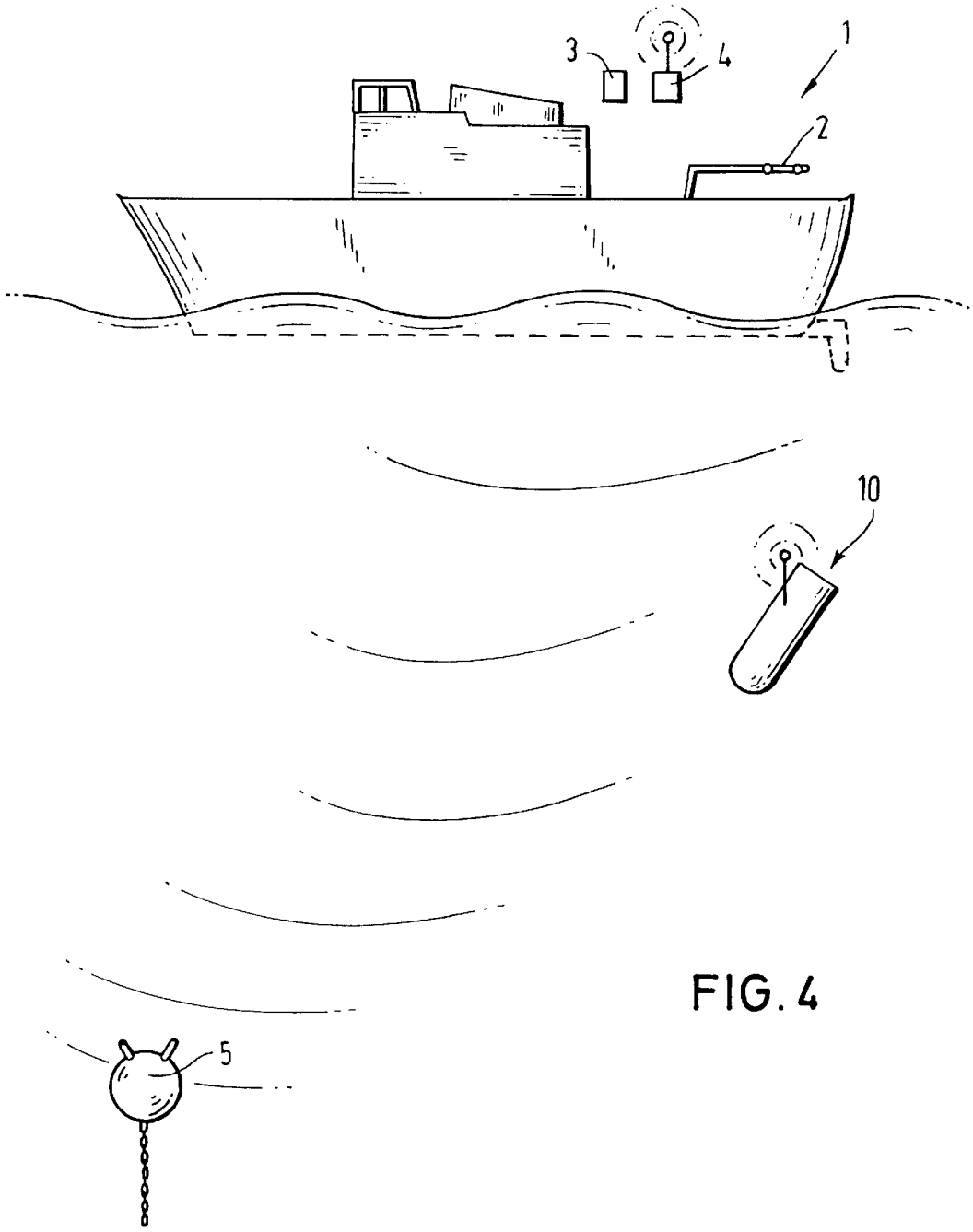
FIG. 4 is a generalized representation of the device according to the invention in an application.

FIG. 4 shows a rough overview of an application of the device according to the invention. Located on board a ship 1, as a base station, are a release-and takeup device 2, a programming device 3 and a remote-control device 4 that are additionally provided for the autonomous operation of the device; the remote-control device 4 can also be installed in the manually-operated buoyant body 12. The release-and-takeup device 2 is mounted, for example, to the stern of the ship 1, and serves in releasing and taking up the capture-and-destroy system 10 or the buoyant body 12, 22 that is guided back.

The method is described in detail in conjunction with FIGS. 1 through 4, taking into consideration FIGS. 5 through 8, and is performed as follows:

After a sea mine 5 has been detected in a known manner, for example through visual contact, in the simple embodiment, the buoyant body 12 with the capture-and-destroy unit 11 is brought, by manual control (manned boat) and the drive motor 13, into the vicinity of sea mine 5 to be captured and destroyed. After the sea mine 5 has been approached (up to about 50 m), it is surrounded completely. Upon the emission of a signal, the capture net 16 is unrolled from the winch 17 and deployed. The winch 17 preferably has a free-wheel drive mechanism for effecting the unrolling, so the capture net 16 can be completely unrolled with the preclusion of mechanical jamming of the winch 17. First, a beginning 35 of the capture net 16 is let down into the water. In the process, an end 36 of the capture net remains on or connected to the winch 17 by a cord 37.1. On the upper side wedge of the capture net 16, a buoyancy cord 37 is guided and connected to the cord 37.1, so the capture net 16, which possesses a plumb cord or weight 38 on its underside wedge, is oriented, as shown, in a substantially vertical direction perpendicular to the sea mine 5 (FIG. 5).

Disposed above the beginning 35 of the net are a float 39 and the drag anchor 34, which is held in the water by the water resistance, thereby floating and holding the beginning 35 of the net on the water. Elements 40, for example a plurality of hooks, are distributed over the width (depth) of the beginning 35 of the capture net. In an advantageous embodiment, a stable, yet flexible band 42 disposed at the end 36 of the capture net assures the perpendicular orientation of the hooks 40 relative to one another. Break-off threads, not shown in detail, connect the float 39 to the beginning 35 of the capture net 16.

After the capture-and-destroy system 10 has completely encircled the sea mine 5 with the deployed capture net 16, the beginning 35 of the capture net, which is visible on the water, is actuated or moved and connected to the end around 36. That is, as the hooks 40 pass over the beginning 35 of the capture net, the hooks engage the mesh of the capture net 16 connected to the buoyant body 12. This process can be observed or indicated by sensors (not shown in detail). The end 36 of the capture net is thus caught. The "roll up" command for the capture net 16 occurs simultaneously with a separation of the capture-and-destroy unit 11 from the buoyant body 12. The closed capture net 16 is hauled in through the reversal of the winch 17, at which time the buoyant body 12 is de-coupled from the capture-and-destroy unit 11 through the detachment of the cables 14, and pulled in the direction of the ship 1. That is, the buoyant body 12 must be separated from the capture-and-destroy unit (CDU) 11 before the sea mine 5 is hauled in to prevent the risk of damage to the buoyant body 12, 22. Afterward, the capture net 16 is rolled in a double thickness onto the winch 17. During the rolling, the float 39, which interferes with the process, breaks off at the break-off thread connecting it to the end 35. Because of the lightweight, textile construction of the drag anchor 34, it can also be rolled up onto the winch 17. Rolling up continues until the sea mine 5 captured in the capture net 16 lies directly against the destroyer unit 11.2. The buoyant body 12, 22 or the actuation of the remote-control device 4 from the ship 1 triggers the detonation of the destructive charge 15. It is also possible, however, to trigger the detonation via a sensor (not shown) that is used to detect the coupling of the mine housing of the sea mine 5, or when coupling is indicated by the fact that the tensile stress of the capture net 16 being rolled up is above a specific value. A timed detonation can also be used. The destructive charge 15 is preferably embodied as a shaped charge, so it can be placed into the capture-and-destroy unit 11 with a position orientation, thus enabling a direct initiation of the explosive of the sea mine 5. As an alternative, it is also possible to embody the effective charge of the destructive charge 15 as a directed or non-directed fragmentation charge.

In the further embodiment (FIG. 6), in which the capture-and-destroy system 10 operates autonomously, the most critical mission data are already read into and deposited in the data memory 28 of the on-board navigation computer 27. Mission data are advantageous when the buoyant body 22 with the drive device 24 brings the capture-and-destroy unit 11 toward the drifting sea mine 5 and surrounds the mine 5 in a semicircle or full circle, de-couples from the capture-and-destroy unit 11 and returns automatically to the ship 1 (as will be explained below). The programming device 3 inputs the target coordinates of the located sea mine 5 into the navigation computer 27, in addition to these mission data, and stores them in the data memory 28. The release-and-takeup device 2 places the capture-and-destroy system 10 into the water, whereupon the system travels to the sea mine 5 at the water's surface. The navigation computer 27 determines the intended course of the capture-and-destroy system 10, and generates the control signals that control the drive motors 25 by way of the control electronics 21. During the startup of the capture-and-destroy system 10, changes in the mine position can be transmitted via the command receiver 20. A remote control can also be effected based on sight. The intended course from the navigation computer 27 is compared to the actual data of the GPS receiver 29, and the intended speed is compared to the actual data of the log 31. The directional gyro 30 effects the course adjustment or correction.

The procedure continues as described above. The buoyant body 22 of the capture-and-destroy system 10 travels full circle until the end 36 of the capture net has been caught by the beginning 35 of the net. Afterward, the capture net 16 is rolled up and the sea mine 5 is pulled toward the destroyer unit 11.2. An advantage of this process is a direct remote control of the capture-and-destroy system 10 through visual contact, so the end 36 of the capture net can be guided over the beginning 35 of the capture net.

Figure 6:
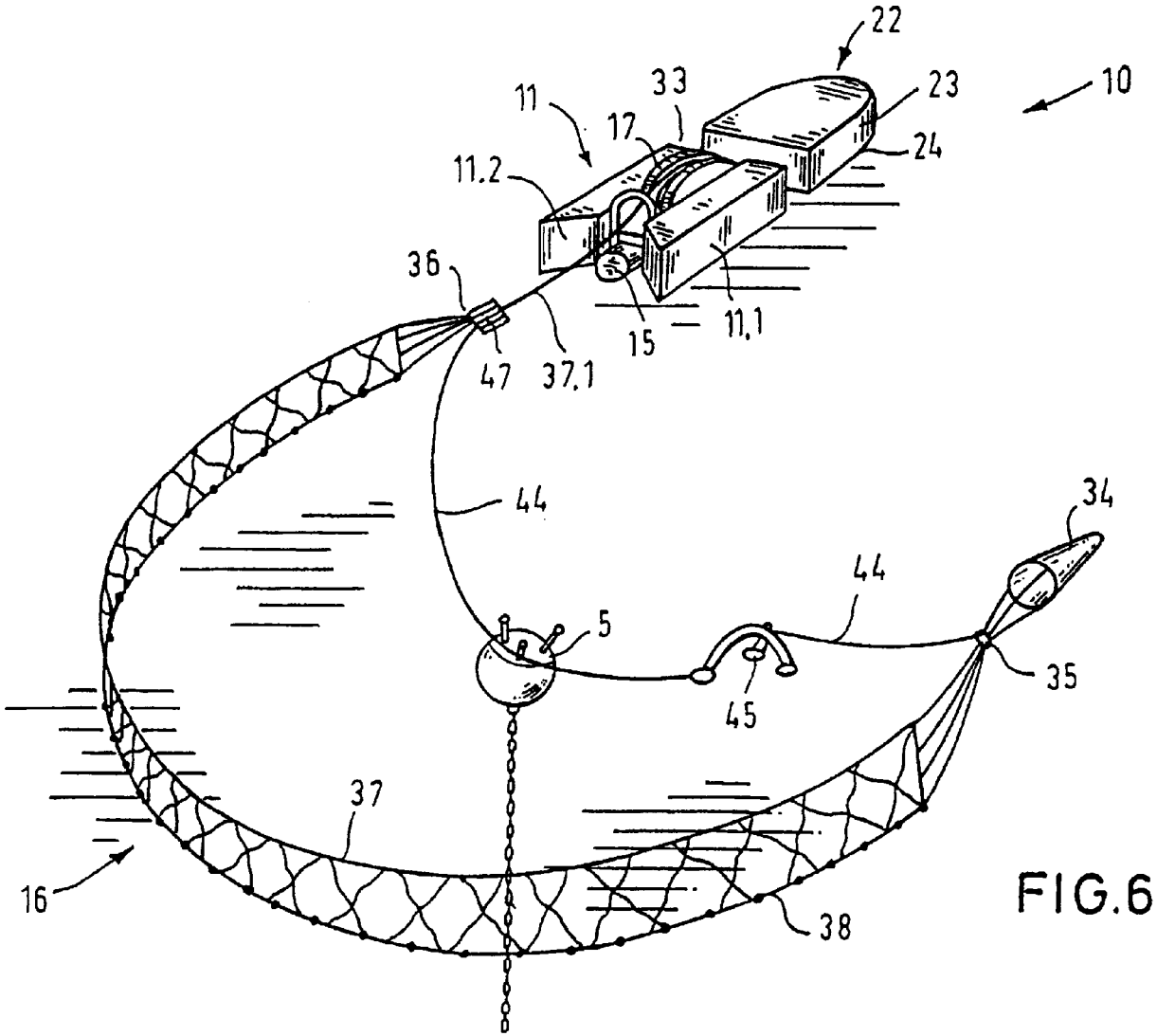
FIG. 6 is a further representation of the capture net in use, with the device of FIG. 2.
Figure 7:
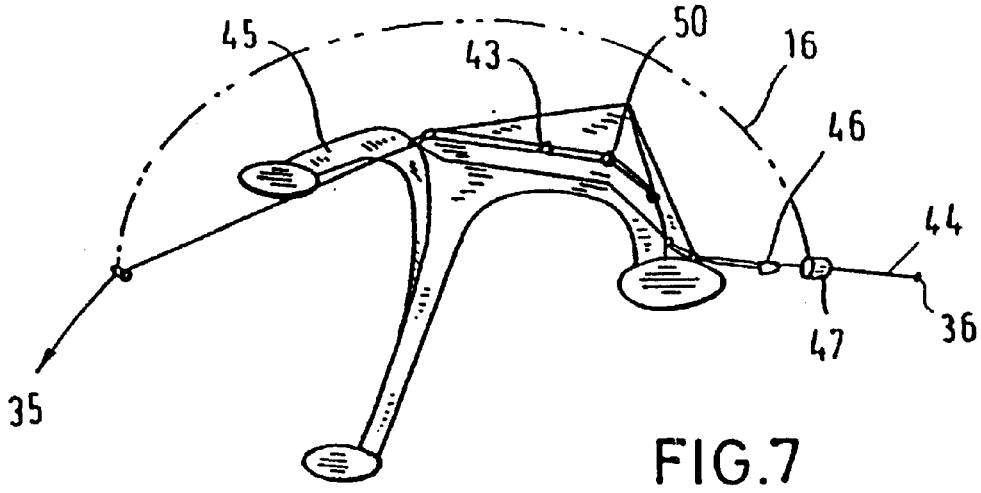
FIG. 7 is a representation of the design of a buoyant body at the capture net.

As an alternative, it is possible to connect elements to the capture net 16 with which the end 36 and beginning 35 of the capture net remain continuously connected to one another while the net 16 is being deployed, and while the sea mine 5 is being hauled in. As shown in FIGS. 6 and 7, a closing line 44, a buoyant body 45 with an auxiliary line 43 and a lock 46, and an intake eyelet 47 at the end 36 of the capture net are integrated into the capture net 16, between the beginning 35 and the end 36 of the net. After the capture-and-destroy system 10 has approached the sea mine 5, a signal from the navigation computer 27 effects the release of the drag anchor 34. The capture-and-destroy system 10 travels in a semicircle around the sea mine 5, with the drag anchor 34 being held back by the water resistance. The capture net 16 is completely unrolled from the winch 17 and deployed. The closing line 44, which is extended with the capture net 16, and is connected to the beginning 35 of the capture net, is likewise guided around the sea mine 5 in a U shape after the capture net 16 has been deployed, and is thus nearly parallel to the capture net 16. After traveling for about 20 more meters, the buoyant body 45 is released and pulled into the water by the closing line 44. The buoyant body 45 is activated by a gas cartridge, not shown in detail, and inflates. The gas cartridge is activated by, for example, an electrically-actuated activation unit (not shown in detail) after the capture net 16 has been unrolled to a length of about 40 m, at which time the activation unit automatically opens the gas cartridge and the buoyant body 45 automatically inflates. The buoyant body 45 is preferably a three-legged buoyant body 45, and is connected to the closing line 44 via an auxiliary line 43 guided through eyelets 50 on the buoyant body 45. An intake eyelet 47, through which the closing line 44 is guided, is disposed at the end 36 of the capture net. The intake eyelet 47 floats at the surface of the water, at the end 36 of the capture net 16, after the net has been completely deployed.

Figure 8A:
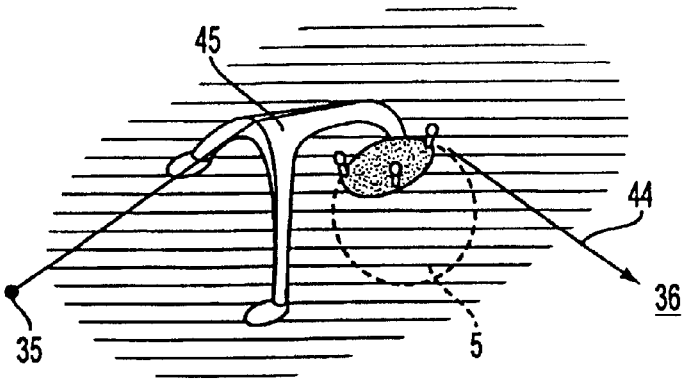
FIGS. 8*a*–8*c* show the sequence of the guidance of the buoyant body over the sea mine with the embodiment according to FIG. 2.
Figure 8B:
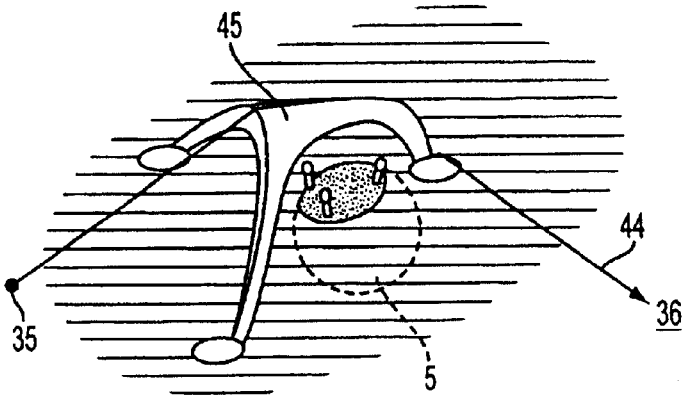
Figure 8C:
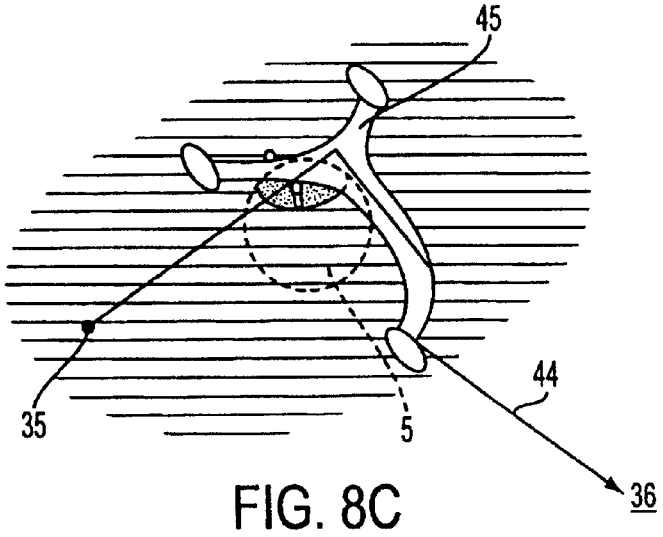

The control electronics 21 activates the process of hauling in the capture net 16. That is, the winch 17 of the capture unit 11.1 is actuated, and first hauls in the closing line 44 with the buoyant body, because the closing line 44 is shorter than the deployed capture net 16. When the capture net 16 is hauled in, the closing line 44 is pulled taut and drawn through the intake eyelet 47. During this process, the buoyant body 45 guides the closing line 44 over the sea mine 5 (FIG. 8). The buoyant body 45 ascends above the sea mine 5, thus guiding the closing line 44 above the mine. As the lock 46 is drawn into the intake eyelet 47, the lock 46 automatically opens, and releases the buoyant body 45 through the pulling of the auxiliary line 43 out of the eyelets 50, which then does not impede the further process of hauling in the capture net. If the closing line 44 has been pulled taut enough that the beginning 35 of the capture net, with the drag anchor 34, has reached the intake eyelet 47 at the end 36 of the capture net, the two are wound onto the winch 17 together. By now at the very latest, the buoyant body 22 can be de-coupled from the capture-and-destroy unit 11. This is effected by the coupling device 33, which mechanically and electronically breaks the connection between the buoyant body 22 and the capture-and-destroy unit 11. This can be effected by a mechanical or pyrotechnical separation of the coupling unit 33; the command for this process is preferably issued by the control electronics 21. The buoyant body 22 can be guided directly back to the ship 1 and stored for re-use. Of course, it is not absolutely necessary to de-couple the buoyant body 22, but this is an appealing option in terms of costs.

Afterward, the captured sea mine 5 is destroyed through the detonation of the destructive charge 15 once the sea mine 5 has docked at the destroyer device 11.2. The capture net 16 has a width (while in use, the depth) of about 1 to 1.5 m, and is about 100 m long from the beginning 35 to the end 36. This size of the capture net 16 ensures that sea mines 5 having a diameter of about 1.20 m can be captured. In such cases, it must be considered that about 90% of the sea mine 5 is located in the water.

The capture net 16 can also be laid into the capture device 11.1 in a meandering shape. The deployment is effected by the drag anchor 34. To haul in the capture net 16, the net is drawn by motor-driven rollers that are pressed together, and placed in the water (not shown in detail). This procedure frees up space in the capture unit 11.1.

Figure 9:
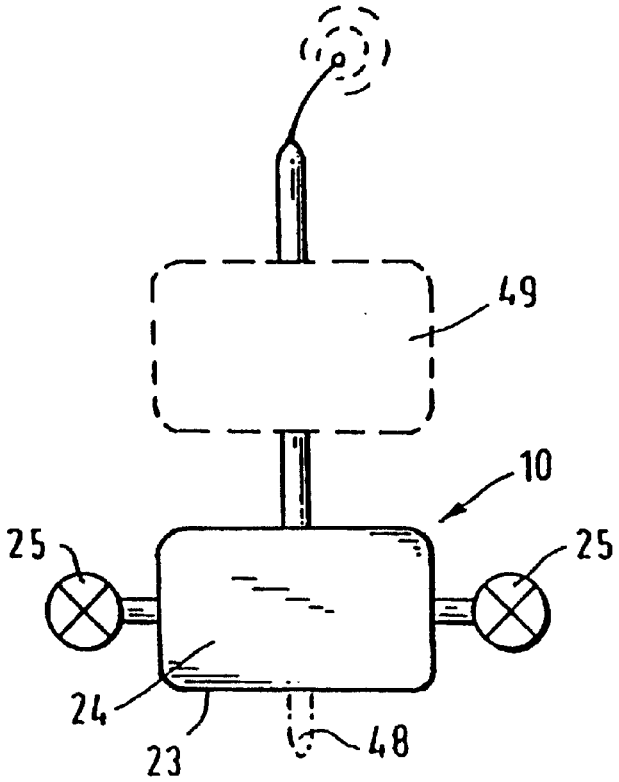
FIG. 9 is a rear view of a buoyant body according to the embodiment of FIG. 2.

The housing 23 of the buoyant body 22 with the drive device 24 of the capture-and-destroy system 10 is embodied such that all of its integrated assemblies, and those secured to the housing 23, are submerged in the water until only about 10% of the volume juts out of the water. This ensures that the drive motors 25 are completely submerged in the water, and that the capture-and-destroy system 10 can even be controlled in rough seas. As show in FIG. 9, the housing 23 preferably employs a keel 48 in securing a defined roll position of the capture-and-destroy system 10 to maintain the bearing of drive motors 25. Instead of a keel, and as further shown in FIG. 9, an additional buoyancy device 49 can be disposed above the housing 23 (FIG. 9). In this case, the weight balance of the capture-and-destroy system 10 is such that the capture-and-destroy system 10 is completely submerged in the water. This assures improved control. The buoyancy device 49 can be embodied to be activated, for example, with a textile body, and filled by a gas cartridge (not shown).

What is claimed is:

1. A method of destroying sea mines drifting in a body of water comprising the following steps;

placing a buoyant body (12, 22) with a capture-and-destroy unit (11) into water;

using the buoyant body (12, 22) to bring the capture-and-destroy unit (11) into the vicinity of the drifting sea mine (5);

deploying a capture net (16) having a beginning (35) and an end (36) from a capture unit of the capture-and-destroy unit to surround the drifting sea mine (5), with the capture net (16) being oriented in a substantially vertical direction around the sea mine (5);

hauling the capture net (16) into the capture unit by winding the end (36) and the beginning (35) of the net into the capture unit (11.1), until the captured sea mine (5) rests against a destroyer unit (11)of the capture and destroy unit, and automatically detonating a destructive charge (15) of the destroyer unit (11.2) to destroy the mine; and wherein the step of deploying includes closing the capture net (16) around the drifting mine by causing the end (36) of the net to engage the beginning (35) of the net (16), so that the net (16) completely surrounds the sea mine (5) at a substantive distance.

2. The method according to claim 1, further comprising de-coupling the buoyant body (12, 22) from the capture-and-destroy unit (11) prior to hauling in the capture net and guiding the buoyant body back to a base station (1).

3. The method according to claim 1, wherein the step of closing the capture net (16) includes pulling a closing line (44) connected between the end (36) and the beginning (35) of the net, to bring the beginning (35) of the net to the end (36) of the net so that, the net (16) completely surrounds the sea mine (5) at a substantial distance.

4. The method according to claim 1 wherein the capture-and-destroy unit (11) is manually brought to the vicinity of the sea mine (5).

5. The method according to claim 1, wherein the capture-and-destroy unit (11) autonomously approaches the vicinity of the sea mine (5).

6. A method of destroying sea mines drifting in a body of water comprising the following steps;

placing a buoyant body (12, 22) with a capture-and-destroy unit (11) into water;

using the buoyant body (12, 22) to autonomously bring the capture-and-destroy unit (11) into the vicinity of the drifting sea mine (5);

deploying a capture net (16) having a beginning (35) and an end (36) from a capture unit of the capture-and-destroy unit to surround the drifting sea mine (5), with the capture net (16) being oriented in a substantially vertical direction around the sea mine (5);

hauling the capture net (16) into the capture unit by winding the end (36) and the beginning (35) of the net into the capture unit (11.1), until the captured sea mine (5) rests against a destroyer unit (11)of the capture and destroy unit;

automatically detonating a destructive charge (15) of the destroyer unit (11.2) to destroy the mine; and collecting mission data and target coordinates of a located sa mine (5) in advance; reading into and storing the data and coordinates in a data memory (28); and transmitting changes in the mine position to the capture and destroy unit during the startup of the capture-and-destroy system (10).

7. A device for destroying drifting sea mines, comprising:

a capture-and-destroy unit mounted to a buoyant body, with the capture and destroy unit including a capture unit and a destroyer unit, which are connected to the buoyant body;

said capture unit including a capture net that is to be deployed so that it surrounds a drifting sea mine and that has a buoyancy cord disposed at an upper edge of the capture net, and a plumb cord disposed at a lower edge of the capture net to orient the deployed capture net in a substantially vertical direction around the sea mine (5);

said capture unit including means, connected to the capture net, for drawing a beginning and an end of the capture net toward the capture unit until the sea mine rests directly against the destroyer unit, and a destructive charge integrated into the destroyer unit and connected to a detonation-and-safety device;

a drag anchor and a float connected to the beginning of the capture net (16), and, the end of the net is connected to the means for drawing and has elements with which the end of the capture net engages the beginning of the capture net.

8. The device according to claim 7, wherein the capture-and-destroy unit is detachably connected to the buoyant body by a coupling device.

9. The device according to claim 7, wherein the elements at the end of the capture net are hooks.

10. The device according to claim 7 wherein the buoyant body is a manually-operated system.

11. The device according to claim 7 wherein the buoyant body has a drive device that drives the buoyant body and comprises drive motors, a navigation system having a navigation computer and a data memory.

12. A device for destroying drifting sea mines, comprising:

a capture-and-destroy unit mounted to a buoyant body, with the capture and destroy unit including a capture unit and a destroyer unit, which are connected to the buoyant body;

said capture unit including a capture net that is to be deployed so that it surrounds a drifting sea mine and that has a buoyancy cord disposed at an upper edge of the capture net, and a plumb cord disposed at a lower edge of the capture net to orient the deployed capture net in a substantially vertical direction around the sea mine (5);

said capture unit further including means, connected to the capture net, for drawing a beginning and an end of the capture net toward the capture unit until the sea mine rests directly against the destroyer unit, and a destructive charge integrated into the destroyer unit and connected to a detonation-and-safety device;

a drag anchor connected to the beginning of the capture net (16);

the beginning of the capture net and the end of the capture net are connected to one another by a closing line;

a buoyant body is mounted to the closing line; and the end of the capture net has an intake eyelet (47), through which the closing line is guided and connected to the means for drawing.

13. A device for destroying drifting sea mines, comprising:

a capture-and-destroy unit mounted to a buoyant body, with the capture and destroy unit including a capture unit and a destroyer unit, which are connected to the buoyant body;

said capture unit including a capture net that is to be deployed so that it surrounds a drifting sea mine and that has a buoyancy cord disposed at an upper edge of the capture net, and a plumb cord disposed at a lower edge of the capture net to orient the deployed capture net in a substantially vertical direction around the sea mine (5);

said capture unit further including means, connected to the capture net, for drawing a beginning and an end of the capture net toward the capture unit until the sea mine rests directly against the destroyer unit, and a destructive charge integrated into the destroyer unit and connected to a detonation-and-safety device;

a drive device on the buoyant body to drive the buoyant body and comprising drive motors, a navigation system having a navigation computer and a data memory; and, means for permitting electrical coupling of a programming device (3) to the navigation computer (27) prior the process of destroying drifting sea mines (5), to cause mission data collected in advance to be read into and stored in the data memory.

14. A device for destroying drifting sea mines, comprising:

a capture-and-destroy unit mounted to a buoyant body, with the capture and destroy unit including a capture unit and a destroyer unit, which are connected to the buoyant body;

said capture unit including a capture net that is to be deployed so that it surrounds a drifting sea mine and that has a buoyancy cord disposed at an upper edge of the capture net, and a plumb cord disposed at a lower edge of the capture net to orient the deployed capture net in a substantially vertical direction around the sea mine (5);

said capture unit further including means, connected to the capture net, for drawing a beginning and an end of the capture net toward the capture unit until the sea mine rests directly against the destroyer unit, and a destructive charge integrated into the destroyer unit and connected to a detonation-and-safety device;

a drive device on the buoyant body to drive the buoyant body and comprising drive motors, a navigation system having a navigation computer and a data memory; and, the navigation system has a GPS receiver for determining the position of the capture-and-destroy system.

* * * * *